United States Patent [19]

Neirynck

[11] Patent Number: 4,733,601

[45] Date of Patent: Mar. 29, 1988

[54] COMBINED SERVO CONTROL AND JACK UNIT

[76] Inventor: Roland Neirynck, 2291 Louis Veuillot Street, Montreal, Canada, H1N 2N5

[21] Appl. No.: 907,378

[22] Filed: Sep. 15, 1986

[51] Int. Cl.[4] ..... F15B 9/10

[52] U.S. Cl. ..... 91/374; 91/443; 92/13.6

[58] Field of Search ..... 91/374, 443, 383, 384; 92/13.6

[56] References Cited

U.S. PATENT DOCUMENTS

| | | | |
|---|---|---|---|
| 2,221,150 | 11/1940 | Rebeski | 91/374 |
| 2,462,932 | 3/1949 | Anderson | 91/374 X |
| 2,470,099 | 5/1949 | Hall | 91/374 X |
| 2,708,909 | 5/1955 | Curlett | 91/443 X |
| 2,882,683 | 4/1959 | Sinclair | 91/374 X |
| 3,044,266 | 7/1962 | Svenson | 91/443 X |
| 3,083,892 | 4/1963 | Carey et al. | 91/374 X |
| 3,086,595 | 4/1963 | Nichols | 91/374 X |
| 3,875,849 | 4/1975 | Patel | 92/374 X |
| 4,192,346 | 3/1980 | Iizumi | 91/443 X |
| 4,320,693 | 3/1982 | Benjamin | 92/13.6 |
| 4,375,942 | 3/1983 | Olson | 91/374 X |

FOREIGN PATENT DOCUMENTS

| | | | |
|---|---|---|---|
| 104082 | 10/1962 | Netherlands | 91/374 |
| 3202 | of 1880 | United Kingdom | 91/374 |

*Primary Examiner*—Robert E. Garrett
*Assistant Examiner*—Mark A. Williamson

[57] ABSTRACT

There is disclosed a combined servo control and jack unit which comprises a casing, an actuated piston slidably disposed in a piston chamber and having a piston rod extending outwardly of the casing. A servo valve chamber, axially parallel to the piston chamber, has slidably mounted therein a spool and also a sleeve member which is mechanically connected to the piston rod. Shifting the spool in either axial direction directs hydraulic fluid to one or the other side of the piston, thus moving the latter until spool stopping, at which time the sleeve automatically, almost instantly, blocks off the flow in the new position. A variable speed, gradual action of the piston is obtained without hydraulic shock or cavitation.

1 Claim, 4 Drawing Figures

COMBINED SERVO CONTROL AND JACK UNIT

FIELD OF THE INVENTION

The present invention relates to a combined servo control and jack unit for regulating the position of an adjustable member, such as the cam plate or swashplate of variable displacement pumps and hydraulic motors as well as the spool of slide valves and distributors.

BACKGROUND OF THE INVENTION

Known units of this type often lack in positioning precision and/or are of complex and expensive construction.

OBJECTS OF THE INVENTION

It is a prime object of the present invention to provide a servo control unit embodied by the combination of a servo valve and hydraulic jack adapted to very accurately control variable displacement piston pumps and the like.

Other objects of the invention are to provide a unit of the character described, which is safe to use and which obviates the problems of hydrualic hammer and cavitation.

It is another object of the present invention to provide a servo control unit of the above type, which is simple in design and non-costly to manufacture.

SUMMARY OF THE INVENTION

The above and other objects and advantages of the present invention are realized according to a preferred embodiment comprising a rigid, preferably box-shaped casing, adapted to be fixed to a stationary structure. The casing is formed with a longitudinal piston chamber extending preferably from end to end. One of the ends is closed and is preferably provided with a stroke-regulating means for the piston. The opposite end is closed by a suitable collar member formed with a central longitudinal bore through which extends the rod of the piston. The rod extends outwardly of the casing and has an outer end secured to, for example, a camplate or swashplate control arm. The piston is of the double-action type, being adapted for longitudinal displacement in either direction in the chamber.

The casing is further formed with a servo valve chamber also extending longitudinally from end to end and which is spaced apart from and parallel to the piston chamber.

A spool extends into the servo valve chamber from either end of the casing. Biasing means may be provided to maintain the spool in centered neutral position. The spool is slidable in either direction from its neutral position under the action of suitable control means.

An elongated sleeve member also extends inwardly into the servo valve chamber, from one end of the casing. The outer end of the sleeve is formed into an axial shaft externally of the casing. The inner portion of the sleeve closely surrounds the inner portion of the spool.

One of the longitudinal casing walls adjacent the valve chamber is provided with a fluid inlet port, which communicates with the servo valve chamber and which is preferably to be connected to a hydraulic source under pressure. The same wall is further provided with a fluid outlet port which also communicates with the servo valve chamber and which leads to a sump. The two ports are longitudinally spaced from each other.

The inner portion of the sleeve and the contiguous inner portion of the spool which extends inside the sleeve are cooperatively constructed and arranged to selectively direct the incoming flow of fluid from the inlet port into one or the other of two spaced-apart entry orifices formed in the sleeve, when the spool is actuated. One of the orifices communicates with a first channel formed in the middle portion of the casing, which in turn communicates with one side of the piston chamber. The other entry orifice communicates with a second channel, also formed in the middle portion of the casing and which communicates with the other side of the piston chamber. The channels do not communicate with each other.

Upon such actuation of the spool, one or the other of two spaced-apart exit orifices, also provided in the sleeve, selectively, almost simultaneously, direct the outflow of fluid into one of two paths to the outlet port, depending on the direction of actuation of the spool. The exit orifices have a cross-sectional size smaller than that of the entry orifices to cause a back pressure in the lower pressure side of the piston chamber. This reduces cavitation and hydraulic hammer.

The shaft end of the sleeve and the outer end portion of the piston rod are joined by direction-reversing mechanical linkage means. Thus, actuating the spool in one direction causes the piston to move in the opposite axial direction and, via the linkage, causes the sleeve to move in the same direction and the same displacement as the spool.

Preferably, relative displacement limit means are provided between the spool and the sleeve.

BRIEF DESCRIPTION OF THE DRAWINGS

The above will be more clearly understood by having referral to the preferred embodiment of the invention, illustrated by way of the accompanying drawings, in which.

Like numerals indicate like elements throughout the drawings.

DETAILED DESCRIPTION OF THE PREFERRED EMBODIMENT

Figures 1, 2:
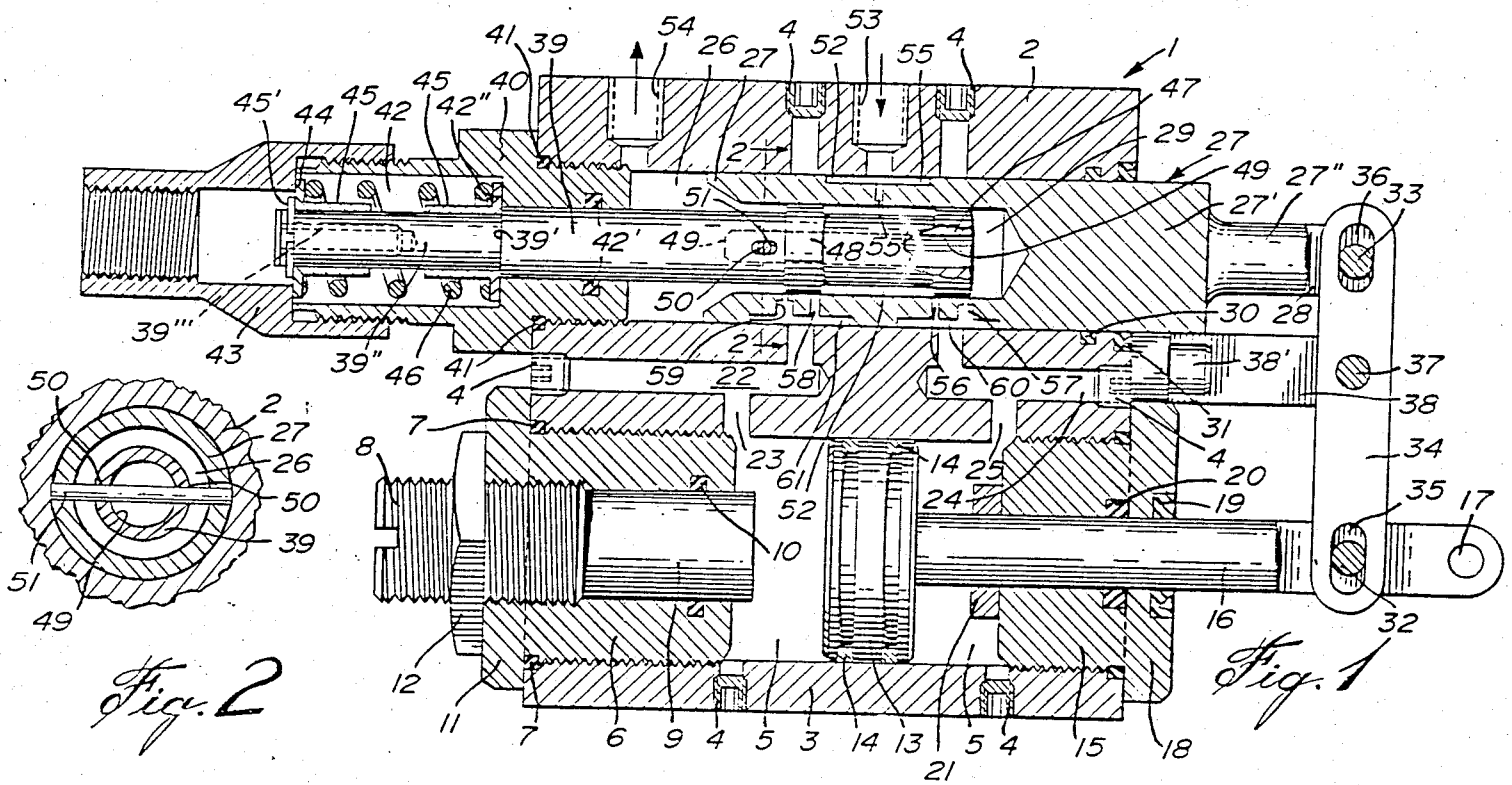
FIG. 1 is a longitudinal vertically cross-sectioned elevation of the servo unit according to the invention showing the elements in centered neutral condition.
FIG. 2 is a partial cross-sectional view taken along lines 2—2 of FIG. 1.

The servo control unit 1 according to the invention is shown with all the movable elements in neutral centered position, in all FIG. 1. Unit 1 is housed in a box-shaped monoblock casing having a top wall 2, a bottom wall 3, a pair of opposite end walls (not seen) and a pair of longitudinal side walls (also not seen). The end walls, the top wall 2 and the bottom wall 3 have plugs 4 closing the outer ends of bores, these outer ends being for machining purpose only.

The monoblock casing may be made of an extruded metallic alloy, such as the alloy known by the trademark name >>DURALUMIN<<, or again by a cast aluminum-bronze laminate. Any other suitable material could be used. For alkaline or acidic mediums, stainless steel is preferred. The casing may be made in any size according to particular applications.

All the various elements which project exteriorly of the casing are preferably made of chromed carbon steel.

Referring to the lower portion of FIG. 1, there is shown the piston chamber 5, which extends longitudinally from end to end of the casing. One end of chamber 5 is sealingly closed. Preferably, this closure is formed by a piston stroke regulating means, consisting of a collar 6 threadedly engaged in the casing and sealed by an O-ring seal 7. Collar 6 carries a large set-screw 8 threadedly engaged therein. The inner unthreaded end 9 of screw 8 forms a piston abutment, whose longitudinal position is adjustable by turning set screw 8, one way or the other. Another O-ring seal 10 is provided to prevent fluid from flowing into the bore of collar 6. A closure cap 11 is integral with the outer end of collar 6 and compresses O-ring 7. A lock nut 12 effectively prevents movement of the set-screw once adjusted.

A piston 13 is slidably mounted in chamber 5. Piston 13 has a pair of rings 14. The opposite end of piston chamber 5 is closed by a second collar 15 threadably engaged therein. Extending through collar 15 is a piston rod 16 connected to the piston and having an outer end projecting exteriorly of the casing. The extreme outer end is flattened and formed with a hole 17. Collar 15 has an integral closure cap 18. O-ring seals 19 and 20 contact piston rod 16 and seal piston chamber 5.

Preferably, a spacer ring 21 surrounds piston rod 16 and contacts the inner face of collar 15.

Spacer ring 21 serves to shorten the stroke of the piston on that side of piston chamber 5. The thickness of ring 21 is selected for the specific application.

The middle portion of the casing is formed with a first longitudinal channel 22 on the left side, as shown, and which communicates with piston chamber 5 by a passage 23. A second similar longitudinal channel 24 communicates by a passage 25 with the opposite side of piston chamber 5.

Referring now to the upper portion of the casing, as shown in the figures, a longitudinal servo valve chamber 26 extends from end to end of the casing in spaced-apart axially parallel relationship above piston chamber 5.

Servo valve chamber 26 has slidably mounted therein an elongated sleeve 27 having a solid outer portion 27' which integrally merges with an outermost shaft portion 27", the latter being flattened at its extremity 28. The inner portion of sleeve member 27 is cylindrical, defining a bore 29 which opens into chamber 26.

Sleeve 27 is held slidably sealed by a pair of annular seals 30, 31.

The outer end of the piston rod 16 and the extremity 28 of sleeve 27 each have a transverse pivot stud 32,33, respectively. A pair of connecting arms 34 (only one is seen) are pivotally attached at their opposite ends to studs 32, 33 through slots 35, 36. The two arms themselves are pivoted about an intermediate transverse pivot 37, which is mounted on a horizontally-projecting member 38 fixed to the right side end wall of the casing by bolts 38'.

At the opposite end of the casing, a spool 39 extends inwardly into slide valve chamber 26. The same end of the latter is sealingly closed by an elongated third collar 40, which has an inner portion threadedly engaged in casing 1 and sealed by an O-ring seal 41. This inner portion has a central longitudinal bore opening outwardly into an external larger diameter bore 42, which is open at its outer end. Spool 39 has a step 39' which defines a smaller diameter outer portion 39", the latter terminating inwardly at the inner end of large bore 42 when in centered position. A seal 42' is provided around spool 39.

A connector 43, for the sheath of a flexible control cable, is screwed onto the outer end of collar 40. The flexible cable is screwed in an axial, threaded bore 39''' of spool portion 39". Connector 43 defines an annular shoulder 44.

The biasing means disclosed above, to maintain the valve 39 in neutral position, consists of a pair of oppositely-disposed flanged sleeves 45 slidable on spool outer portion 39" and between which is located a helical compression spring 46. All these elements are located in external bore 42, one of the flanged sleeves 45 abutting shoulder 44 and the other abutting a shoulder 42" at the inner end of bore 42.

When spool 39 is pulled to the left by the control flexible cable, right-hand flanged sleeve 45 is pushed to the left by step 39' and this compresses spring 46 against left-hand flanged sleeve 45, which is retained by shoulder 44. When spool 39 is pushed to the right by the flexible cable, left-hand flanged sleeve 45 is pushed to the right by a split washer 45' retained on spool outer portion 39". This compresses the spring against right-hand flanged sleeve 45 which is retained by shoulder 42". Control of spool 39 can, obviously, be obtained by other means than by a flexible cable.

The inner portion of the spool 39 extends into the bore 29 of sleeve 27. A pair of longitudinally-spaced first and second circumferential bosses 47, 48, respectively, are provided at the inner end and intermediate areas, respectively, of the spool 39.

This inner portion of spool 39 is further made with an axial passage 49 extending from the inner end of the spool 39 and terminating beyond outer boss 48. Slightly inwardly of the end of passage 49, spool 39 has a pair of slots 50 which communicate with passage 49 (see FIG. 2). Extending through slots 50 is a diametrically-projecting pin 51 which has its ends rigidly secured to the cylindrical portion of sleeve 27. Thus, sleeve 27 and spool 39 are free to slide relative to each other for a distance not exceeding the length of slots 50. This arrangement constitutes the relative displacement limit means, also disclosed above.

The diameter of both bosses 47, 48 is minutely less than the diameter of the inner surface of sleeve 27 at its cylindrical portion. This provides for sealingly slidable contact between the bosses of spool 39 and sleeve 27 and further defines a sealed space 52 between the two bosses—when the spool and sleeve are in neutral position—except for the fluid inlet port 53, which communicates constantly with this space 52.

Top wall 2 is made with the fluid inlet port designated at 53, as well as a fluid outlet port 54. As shown, port 53 overlies space 52 and communicates with a wide slot-like aperture 55 formed in the adjacent portion of sleeve 27, aperture 55 in turn communicating with a small bore 55', always in communication with space 52.

Still referring to FIG. 1, the lower portion of sleeve 27, immediately under first boss 47, has a first pair of orifices consisting of an inlet orifice 56 and a closely, outwardly-spaced outlet orifice 57. Similarly, the portion of sleeve 27 immediately under second boss 48 has a second pair of orifices consisting of another inlet orifice 58 and another outlet orifice 59. Both inlet orifices 56, 58 are adjacent sealed space 52, while both outlet orifices 57, 59 are spaced away from sealed space 52. As shown, the outlet orifices 57 and 59 have smaller neck portions than the inlet orifices. Both the first and second pairs of orifices open out into wide slot-like openings 60,61, respectively, which communicate with channels 24, 22, respectively.

Figure 3:
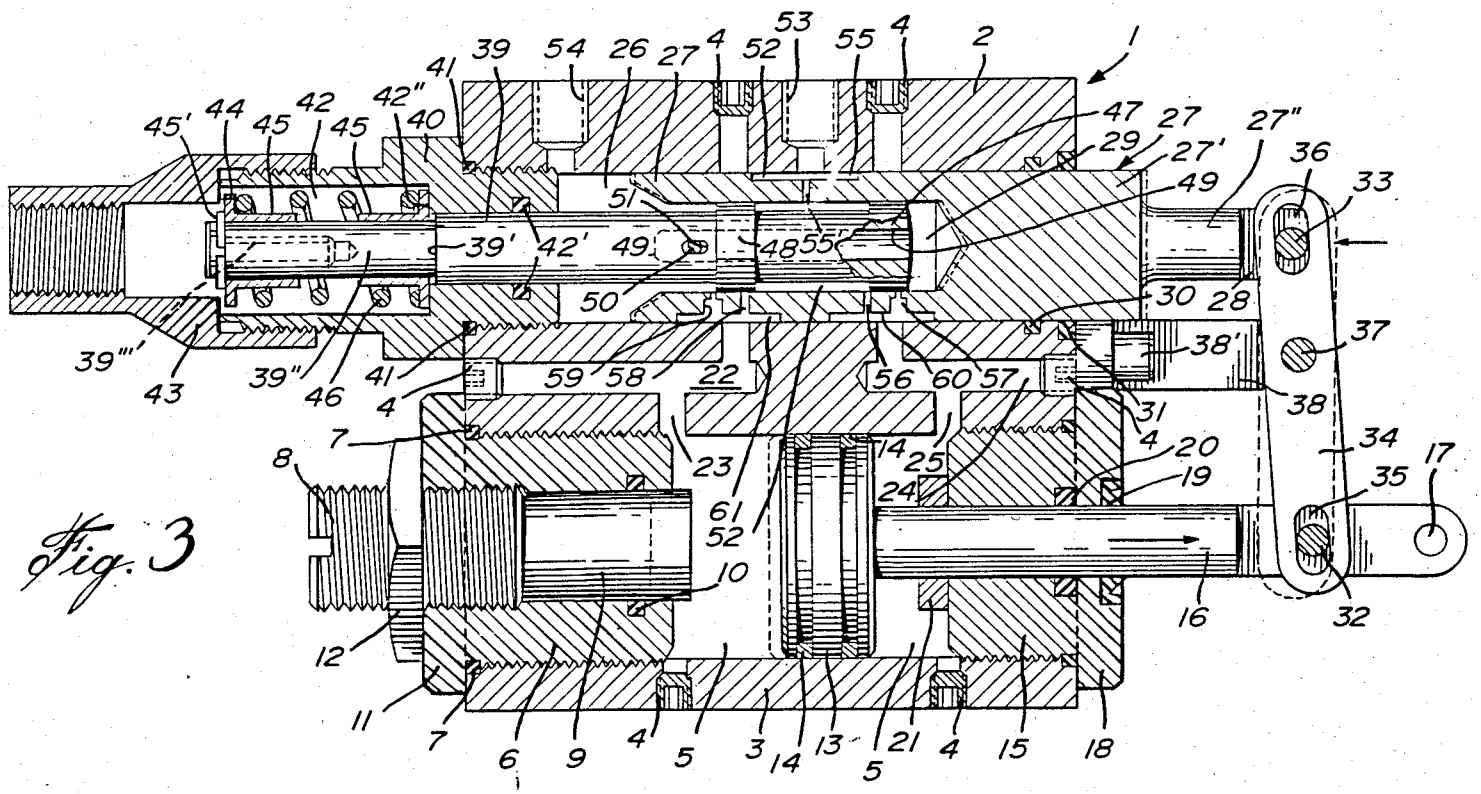
FIGS. 3 and 4 are longitudinal sections of the unit showing the two relative positions of the spool and sleeve for moving the piston in the two opposite directions.
Figure 4:
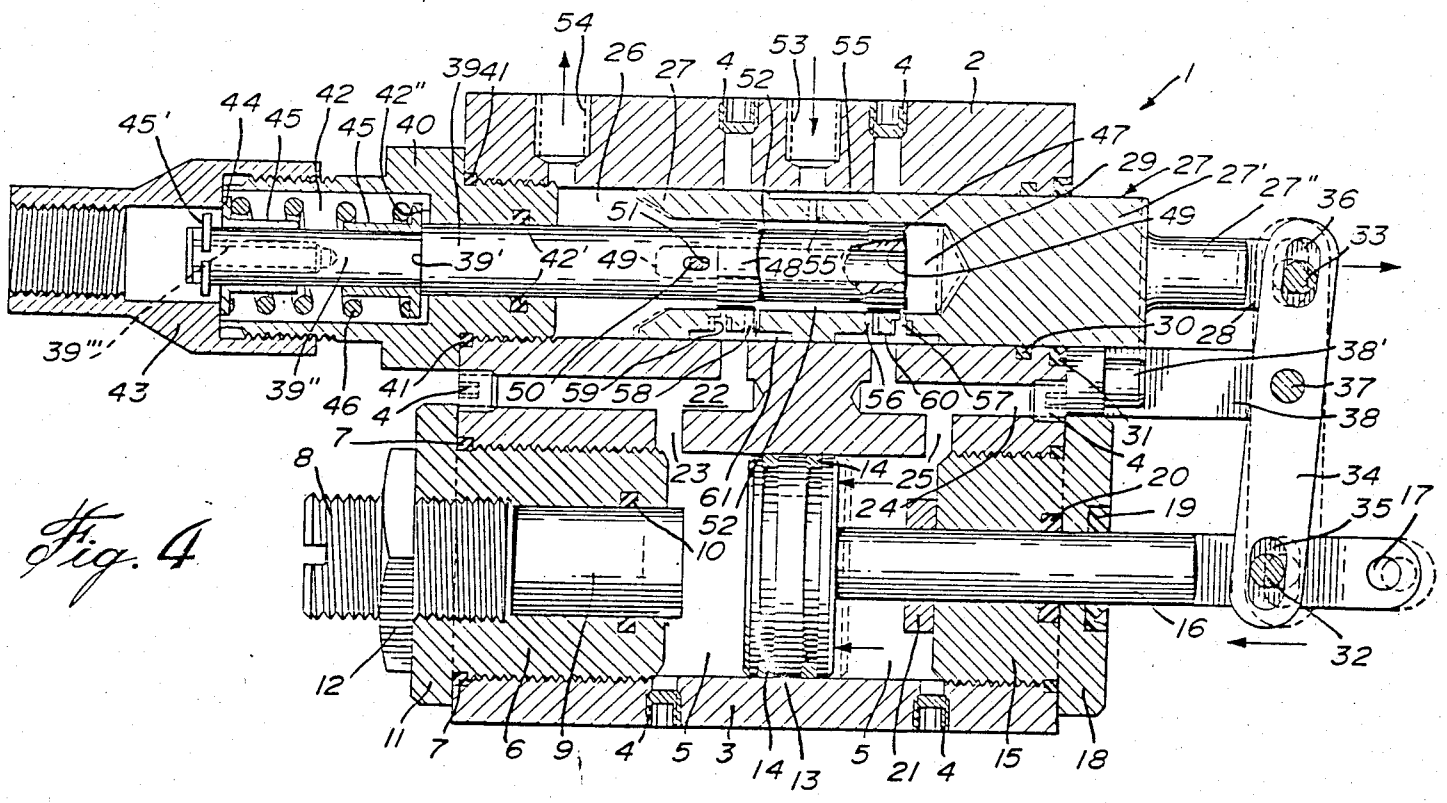

Referring now to FIGS. 3 and 4, the operation of the servo control unit 1 is depicted. In FIG. 3, the spool 39 is given thrust or movement from left to right, thereby moving first boss 47 sufficiently to unblock inlet orifice 56 and moving second boss 48 similarly to unblock outlet orifice 59 of the second pair of orifices. Thus, fluid from sealed space 52 between the bosses 47, 48 will flow through inlet orifice 56, into channel 24 and so exert a leftwardly-acting force on piston 13 in chamber 5. Piston 13 will respond because fluid on the other side of chamber 5 will flow through channel 22, outlet orifice 59 and into slide valve chamber 26. From the latter, the fluid exits through outlet port 54. As piston 13 responds, connecting arms 34 will pivot about pivot 37, thereby causing sleeve 27 to slide porportionally in the same direction and for the same distance as the spool 39. As a result, sleeve 27 automatically reblocks both pairs of orifices and piston 13 is once again, and almost instantly, immobilized, so that piston rod 16 may control the position of the movable member of any device connected to its outer end.

In FIG. 4, there is shown the reverse motion, wherein spool 39 is actuated by traction (in the drawing, movement from right to left). It will be clear that such movement will unblock the other inlet orifice 58 as well as the other outlet orifice 57. Piston 13 is then moved in the direction opposite to that of FIG. 3 and sleeve 27 again moves in the same direction as spool 39 to automatically reblock the orifices. The return path of the fluid is not the same as that shown in FIG. 3. However, instead of flowing directly into slide valve chamber 26 outwardly of the boss, the fluid is circulated through outlet orifice 57 into the end portion of bore 29. From there the fluid is directed to axial passage 49, thence out through slots 50 into the open portion of slide valve chamber 26.

It is to be noted that, if a gradual or modulated action of the piston is desired, it will suffice to exert a regular variable or traction or thrust on spool 39 in the desired direction and until either axial limit position is reached. Since the stroke of the piston 13 is adjustable both by the piston stroke-regulating means and by ring-like spacer 21, a variety of applications are possible. As well, a very precise adjustment of the limit positions of the unit is also possible.

It is to be further noted that it is also possible to have a back-and-forth alternating movement of the piston by reciprocating the spool. In this function, the servo unit eliminates any hydraulic shock or cavitation, because of the construction and calibration of the oulet orifices which create a certain amount of back-pressure on the leading side of piston 13 and very close to piston chamber 5. If the restriction was located at outlet port 54, the difference in the forces required to move spool 39, in the two opposite directions, would be increased.

Moreover, the speed of response of the servo unit is variable due to the calibration of the two pairs of orifices. A gradual action can thus be obtained.

It is to be further noted that the relative displacement limit means between the sleeve and the spool effectively prevents a too forceful or accidental full-stroke displacement of the piston. The piston, according to the provision of the elements described, can only react progressively.

In case of a rupture in the hydraulic feed line connected to the servo unit, the spool will practically instantly close the orifices, thereby blocking the pistons.

In service the operating pressure of the servo valve may vary from 25 to 3000 lbs/sq. inch, or even higher.

It is to be understood that the casing of the servo unit of the present invention is to be secured to a stationary support, so that piston rod 16 may control with precision a movable member, the position of which is to be varied, for instance, the swashplate of a variable flow hydraulic pump.

What I claim is:

1. A servo control jack unit comprising: a rigid casing having a longitudinal piston chamber opening at first and second ends of said casing; a piston axially slidable in either direction located in said chamber; a piston rod fixed to said piston at one end and projecting outwardly of said first end of said casing at its other outer end; a first collar threadedly, sealingly engaged in said piston chamber at said second end of said casing; a setscrew threadedly, centrally engaged in said first collar, and engageable with said piston; a lock nut threaded around the external portion of said setscrew; a longitudinal servo valve chamber in said casing, spaced apart from said piston chamber, generally parallel to the latter and opening at said first and second ends of said casing; a spool extending into said servo valve chamber from said second end of said casing; a second collar threadedly, sealingly engaging said servo valve chamber at said second end of said casing, said second collar having an outwardly-opening large diameter bore through which extends the outer portion of said spool; biasing means located in said large diameter bore of said collar to maintain said spool in centered position; actuating means to move said spool to either axial direction from said centered position; a sleeve member extending into said servo valve chamber from the first end of said casing; said sleeve member having a sliding fit with said servo valve chamber and including an inner cylindrical portion opened only at one end and closely surrounding the inner portion of said spool; said sleeve member further having an external outer end; a mechanical direction reversible linkage means pivotally secured to said first end of said casing, to said outer end of said sleeve member and to the outer portion of said piston rod; said casing further having, in one wall thereof, a fluid inlet port and a fluid outlet port, each communicating with said servo valve chamber; separate first and second channels formed in said casing between said servo valve member and said piston chamber and respectively communicating with said servo valve chamber on opposite sides of said piston; said inner cylindrical portion of said sleeve member being formed with a first pair of orifices, including an entry orifice and an exit orifice, and a second pair of inwardly-spaced orifices, also including an entry orifice and an exit orifice; said first pair of orifices communicating with said first channel and said second pair of orifices communicating with said second channel; said inner cylindrical portion of said sleeve member and the contiguous inner portion of said spool being cooperatively constructed and arranged to selectively direct an incoming flow of fluid from said inlet port into one or the other of said entry orifices upon actuation of said spool, and to direct the return flow of fluid into one or the other of said exit orifices; then along one of two paths to said outlet port; said exit orifices having a smaller cross-sectional area than that of said entry orifices; said inner portion of said spool being formed with a first and a second circumferential boss at the inner end and intermediate area, respectively, thereof; said inner portion of said spool being further provided with an axial passage extending from the inner end thereof to slightly beyond said second boss; a pair of transversely-registering, longitudinally-extending slots provided in said spool beyond said second boss and communicating with said axial passage; a transverse pin fixed to said inner cylindrical portion of said sleeve member at its ends and freely extending through said slots to limit relative displacement of said spool and sleeve member; both said bosses having a sliding fit with the inner surface of said inner cylindrical portion of said sleeve member; said bosses defining a sealed space between themselves, said inlet ports communicating with said sealed space; each said pair of said orifices being blockable by the corresponding said boss; both said entry orifices being closer to said sealed space than the paired said exit orifices; said exit orifice of said first pair of orifices, said axial passage and said slots constituting one of said paths for the returning fluid; said exit orifice of said second pair of orifices and said servo valve chamber constituting the other more direct one of said paths for the returning fluid; both orifices of each said pair being spaced closely enough together to be completely blocked by the corresponding said boss; whereby said piston responds at variable speed and with gradual action to spool actuation without hydraulic shock or cavitation.

* * * * *